US008807800B2

(12) United States Patent
Lin et al.

(10) Patent No.: US 8,807,800 B2
(45) Date of Patent: Aug. 19, 2014

(54) ILLUMINATION STRUCTURE AND ASSEMBLY METHOD OF LIGHT BASE AND COVER

(71) Applicant: Lextar Electronics Corporation, Hsinchu (TW)

(72) Inventors: Yu-Min Lin, New Taipei (TW); Cheng-Chun Liao, Hsinchu (TW); Ya-Wen Chen, Yilan (TW); Chia-Shen Cheng, Taichung (TW); Chang-Han Chen, Xinpu Township, Hsinchu County (TW); Chin-Chang Hsu, Pingtung (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 13/658,251

(22) Filed: Oct. 23, 2012

(65) Prior Publication Data

US 2013/0107541 A1 May 2, 2013

(30) Foreign Application Priority Data

Nov. 2, 2011 (TW) ..... 100139910 A

(51) Int. Cl.

| | |
|---|---|
| ***F21V 3/00*** | (2006.01) |
| ***F21V 5/00*** | (2006.01) |
| ***F21V 7/00*** | (2006.01) |

(52) U.S. Cl.

USPC ..... 362/311.06; 362/296.05; 362/310; 362/375

(58) Field of Classification Search

USPC ..... 362/216, 249.01, 249.02, 257, 296.05, 362/311.02, 310, 362, 363, 374, 375

See application file for complete search history.

(56) References Cited

U.S. PATENT DOCUMENTS

| | | | | |
|---|---|---|---|---|
| 4,035,681 | A | 7/1977 | Savage, Jr. | |
| 7,325,949 | B1 | 2/2008 | Wang | |
| 2007/0247046 | A1 * | 10/2007 | Wu et al. | 313/112 |
| 2008/0137347 | A1 * | 6/2008 | Trott et al. | 362/311 |
| 2009/0273273 | A1 * | 11/2009 | Guo et al. | 313/493 |
| 2010/0109499 | A1 | 5/2010 | Vilgiate et al. | |
| 2012/0190800 | A1 * | 7/2012 | Felice et al. | 525/419 |

FOREIGN PATENT DOCUMENTS

| | | |
|---|---|---|
| GB | 898764 | 6/1962 |
| JP | 60179056 | 11/1985 |
| TW | M381743 | 6/2010 |
| TW | M387197 | 8/2010 |
| WO | 2011105049 A1 | 9/2011 |

OTHER PUBLICATIONS

English language translation of abstract of TW M381743 (published Jun. 1, 2010).
English language translation of abstract of TW M387197 (published Aug. 21, 2010).
EP Search Report dated Feb. 6, 2013.

* cited by examiner

*Primary Examiner* — Donald Raleigh
(74) *Attorney, Agent, or Firm* — McClure, Qualey & Rodack, LLP

(57) ABSTRACT

An illumination structure including an illumination module, a light base and a cover is provided. The light base includes a cylindrical shell and an electrical connector, wherein the cylindrical shell is used for receiving and supporting the illumination module. A first end of the cylindrical shell has a first edge including a plurality of protrusions. A second end of the cylindrical shell is connected to the electrical connector. The cover has a second edge including a plurality of recessions. Each recession is complementary in shape to a corresponding protrusion, so that the protrusions are received in corresponding recessions respectively.

11 Claims, 8 Drawing Sheets

ILLUMINATION STRUCTURE AND ASSEMBLY METHOD OF LIGHT BASE AND COVER

This application claims the benefit of Taiwan application Serial No. 100139910, filed Nov. 2, 2011, the subject matter of which is incorporated herein by reference.

BACKGROUND OF THE INVENTION

1. Field of the Invention

The invention relates in general to an illumination structure, and more particularly to an illumination structure for making the cover and the light base conveniently engaged with each other.

2. Description of the Related Art

Referring to FIG. 1, a schematic diagram of a light bulb structure 50 according to the prior art is shown. Normally, the light bulb structure 50 available in the market includes a cover 51 and a lamp body 53. The cover 51 and the lamp body 53 are coupled through a junction C on a straight line. At the junction C, normally the cover 51 has a latch and the lamp body 53 has a slot. The cover 51 is coupled to the lamp body 53 through the engagement between the slot and the latch. However, the apparent seam on the junction C jeopardizes the aesthetics of the external appearance of the illumination structure 50. Furthermore, since the junction C is not completely sealed, insects or dust may enter the light bulb structure 50 via the seam at the junction C if no adhesive is applied to seal the seam between the slot and the latch. Furthermore, since the slot and the latch once engaged cannot be disassembled, it would be very difficult to repair or service the internal elements of the light bulb structure 50.

SUMMARY OF THE INVENTION

The invention is directed to a structural design making the assembly and disassembly of a cover and a bulb of an illumination structure more easily and at the same time increasing the seal tightness between the cover and the light base to avoid the internal elements of the illumination structure being polluted. The invention is also directed to a coupling mechanism at the junction of the illumination structure to prettify the external appearance of the illumination structure.

According to an embodiment of the invention, an illumination structure including an illumination module, a light base and a cover is provided. The light base includes a cylindrical shell and an electrical connector, wherein the cylindrical shell is used for receiving and supporting the illumination module, and has a first end and a second end respectively. The first end has a first edge including a plurality of first protrusions and/or first recessions. The second end is connected to the electrical connector. The cover has a second edge including a plurality of second recessions and/or second protrusions. Each second recession and/or each second protrusion is complementary in shape to a corresponding first protrusion and/or first recession, so that the first protrusions are received in corresponding second recessions, and/or the second protrusions are received in corresponding first recessions respectively.

In an exemplary embodiment, the second recessions and/or the second protrusions of the cover respectively include an inner flange for increasing the seal tightness between the cover and the light base.

In an exemplary embodiment, the part of the first protrusions closer to the first edge has a first width, and the part of the first protrusions farther away from the first edge has a second width greater than the first width. Therefore, each first protrusion has two symmetric concave edge portions for the first protrusions to be conveniently received in the first recessions.

In an exemplary embodiment, the part of the second protrusions closer to the second edge has a third width, and the second protrusions farther away from the second edge has a fourth width greater than the third width. Therefore, each of the second protrusions has two symmetric concave edge portions enabling the second protrusions to be received in the second recessions.

In an exemplary embodiment, the shape of the first protrusions and the second protrusions is circular or polygonal.

In an exemplary embodiment, a reflective material is disposed on an inner surface of the first protrusions.

In an exemplary embodiment, the first protrusions may reflect the light emitted by the illumination module.

In an exemplary embodiment, the cover is formed by an elastic recoverable material.

In an exemplary embodiment, the light base has an accommodation space used for receiving a driving circuit module.

The invention further provides an assembly method of the cover and the light base used for assembling the light base and the cover of the above exemplary embodiments. The cover is pressed inwardly until the second recessions are aligned to the first protrusions and/or the second protrusions are aligned to the first recessions, so that the first protrusions are received in corresponding second recessions and/or the second protrusions are received in corresponding first recessions respectively when the cover is released.

Since the cover and the light base are assembled by way of receiving the protrusions in corresponding recessions, it is much easier to disassemble the cover and the light base for maintenance. In addition, the structural design of protrusions or recessions of the invention makes the cover and the light base engaged with each other even more tightly.

The above and other aspects of the invention will become better understood with regard to the following detailed description of the preferred but non-limiting embodiment(s). The following description is made with reference to the accompanying drawings.

DETAILED DESCRIPTION OF THE INVENTION

A number of exemplary embodiments are disclosed below with accompanying drawings.

Figure 1:
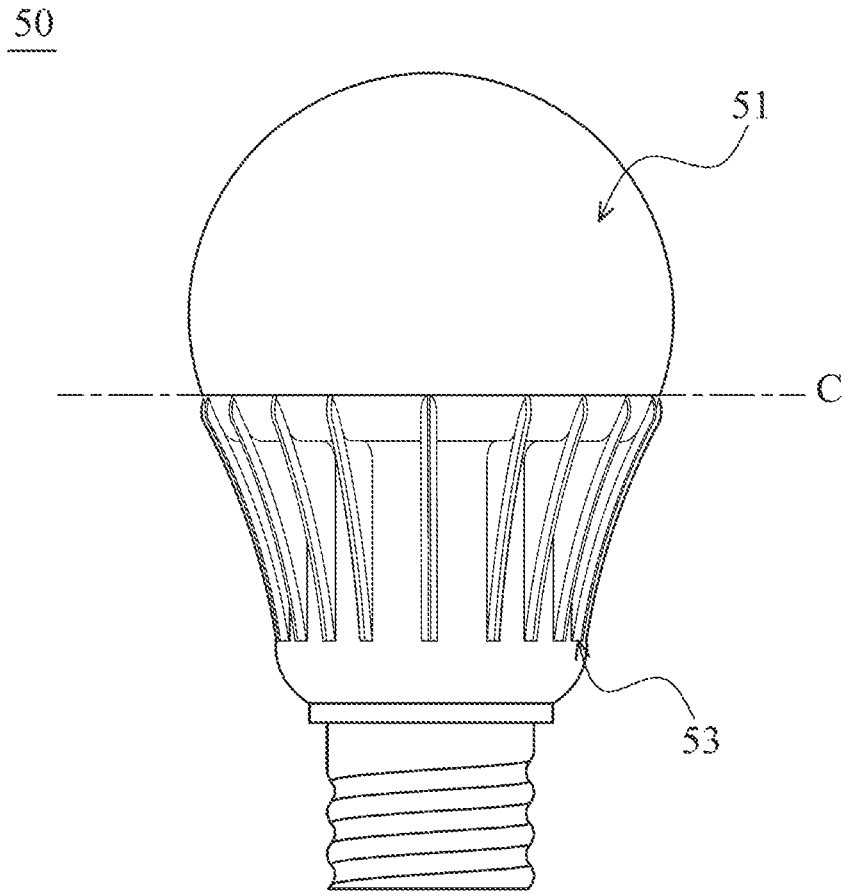
FIG. 1 (Prior Art)
FIG. 1 shows a schematic diagram of a light bulb structure according to the prior art.
Figure 2:
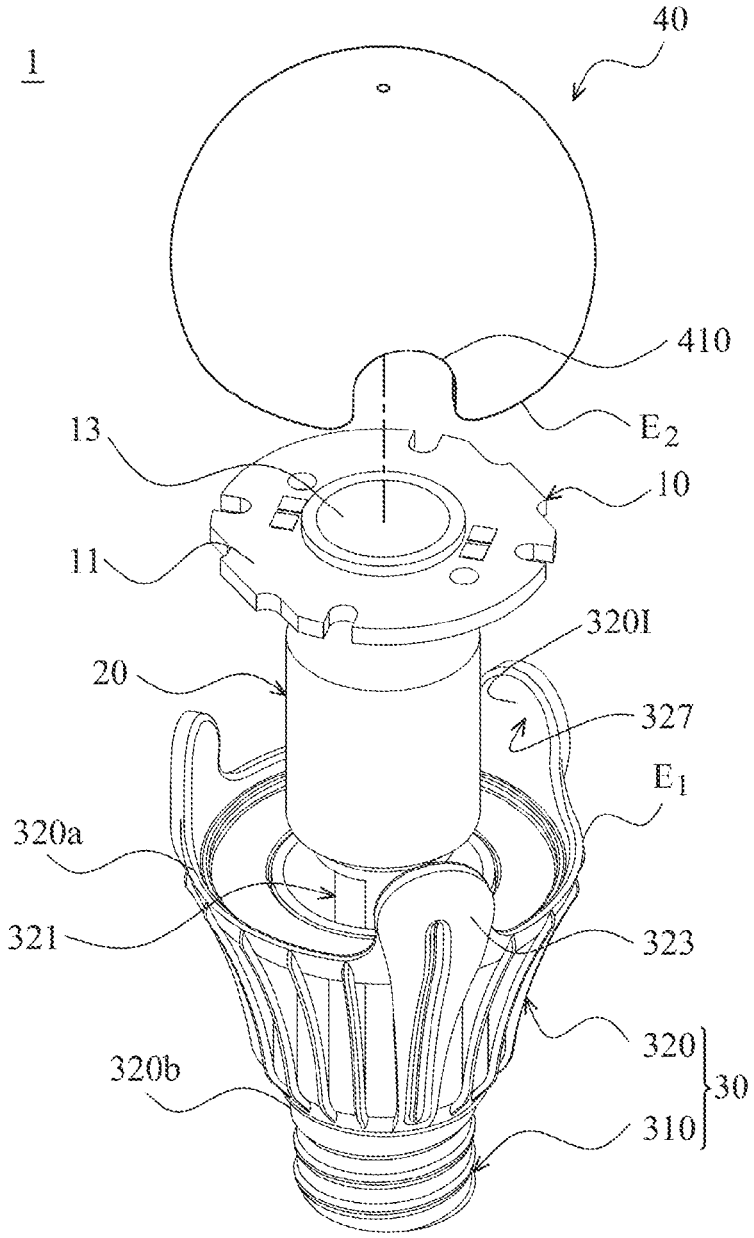
FIG. 2 shows an explosion diagram of an illumination structure according to an exemplary embodiment of the invention.

Referring to FIG. 2, an explosion diagram of an illumination structure 1 according to an exemplary embodiment of the invention is shown. The illumination structure 1 includes an illumination module 10, a driving circuit module 20, a light base 30 and a cover 40.

The illumination module 10 is disposed on the light base 30 and controlled by the driving circuit module 20. In the present embodiment, the illumination module 10 is an LED illumination module including a circuit board 11 and an LED 13, but the invention is not limited thereto. For example, the illumination module 10 may also be realized by a conventional bulb lamp. The light base 30 includes an electrical connector 310 and a cylindrical shell 320. The physical center of the cylindrical shell 320 has an accommodation space 321 for receiving the driving circuit module 20. A first end 320*a* of the cylindrical shell 320 includes a first edge $E_1$, and the first edge $E_1$ includes three first protrusions 323. Conversely, a second end 320*b* of the cylindrical shell 320 opposite to the first end 320*a* is connected to the electrical connector 310. The first protrusions 323 extend upwards from the first edge $E_1$ along the second end 320*b* of the cylindrical shell 320 in a direction towards the first end 320*a*. Each first protrusion 323 may be formed by a light reflecting material. Alternatively, the inner surface 320I of each first protrusion 323 may include a reflective material 327 for reflecting the light emitted by the illumination module 10.

Figure 3:
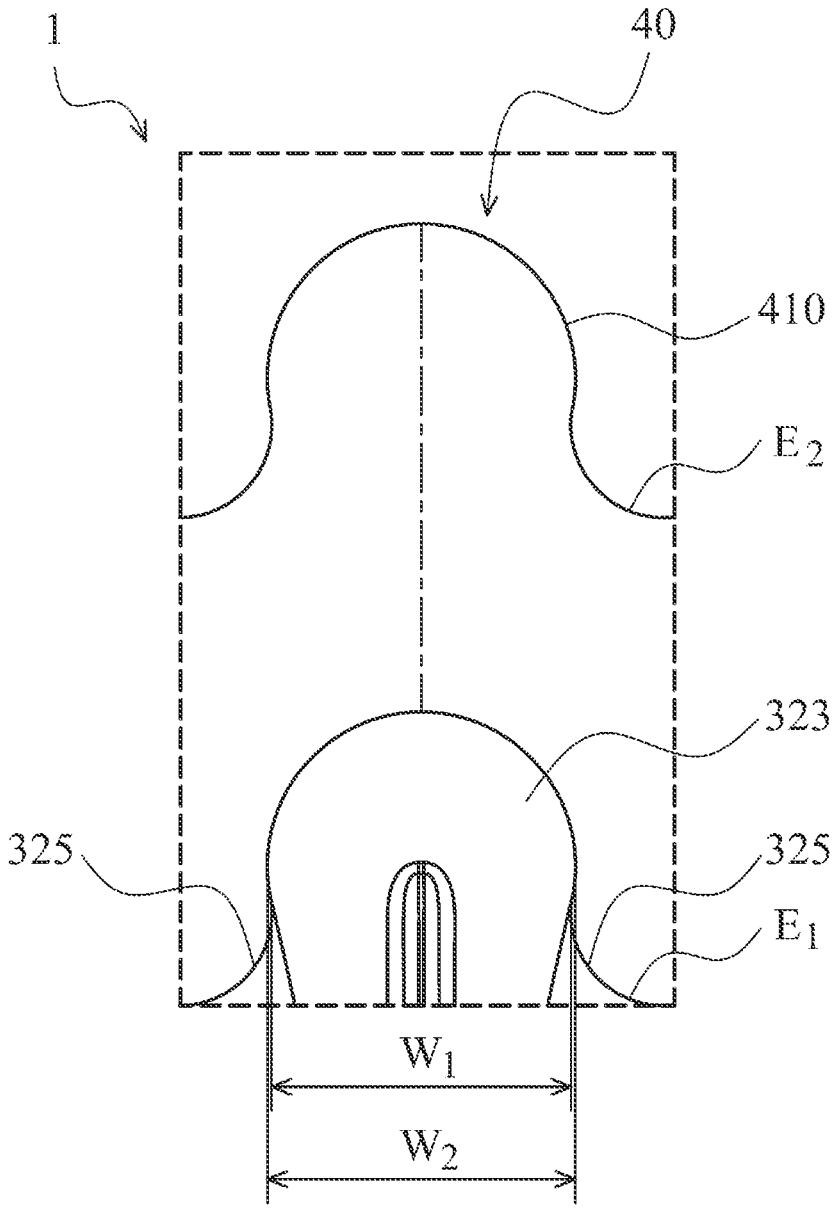
FIG. 3 shows an enlargement diagram of partial elements of an illumination structure according to an exemplary embodiment of the invention.

Referring to FIG. 3, an enlargement diagram of partial elements of an illumination structure 1 according to an exemplary embodiment of the invention is shown. In a practical embodiment, the shape of the first protrusions 323 is circular, and the part of the first protrusions 323 closer to the first edge $E_1$ has a first width $W_1$, and the part of the first protrusions 323 farther away from the first edge $E_1$ has a second width $W_2$ greater than the first width $W_1$. Therefore, the part of each first protrusion 323 closer to the first edge $E_1$ has two concave edge portions 325 for the cover 40 to be conveniently engaged thereon. In the present embodiment, the two concave edge portions 325 are symmetric to each other, but the invention is not limited thereto.

Figure 4:
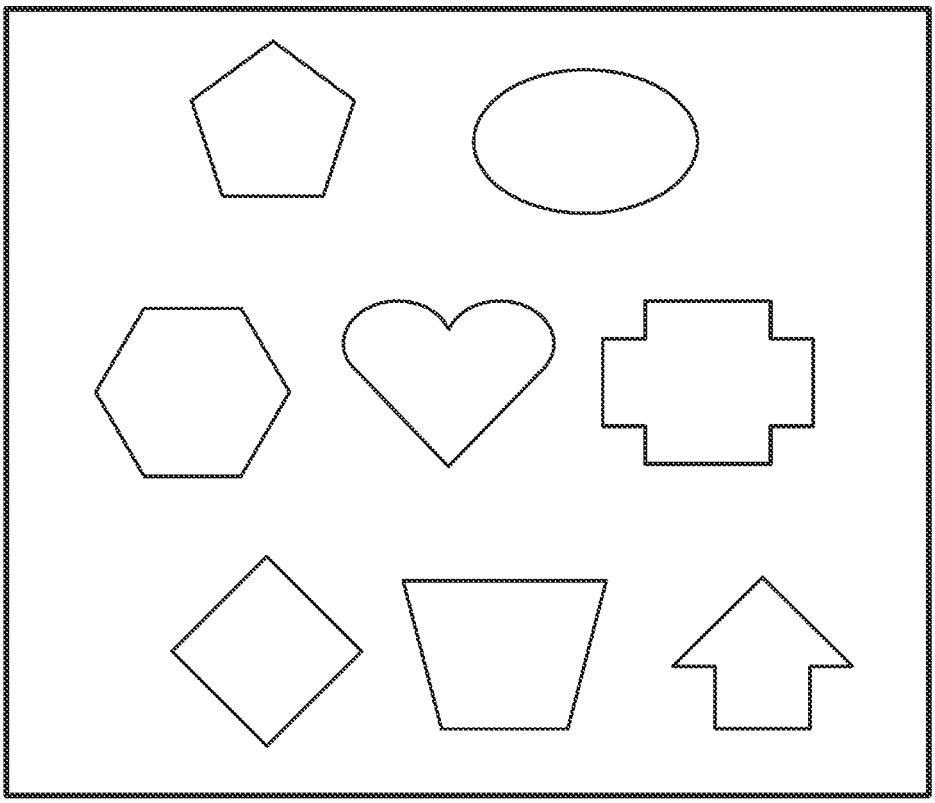
FIG. 4 shows a schematic diagram of possible shapes of a first or a second protrusion according to an exemplary embodiment of the invention.

In the above embodiment, the shape of the first protrusions 323 is circular, but the invention is not limited thereto. As indicated in FIG. 4, the first protrusions may be in the shape of a polygon such as pentagon, hexagon, oval, heart, rhombus, trapezoid, key head, or cross. Of the possible shapes of the first protrusion 323, the part of the first protrusions 323 with largest width is located between a side by which the first protrusion 323 is connected to the first edge $E_1$ and the outer end of the first protrusion 323 (including the outer end) for the cover 40 to be conveniently engaged thereon. Preferably, the part of the first protrusions 323 with largest width is located between the physical enter of the first protrusion 323 and its outer end.

Referring to FIGS. 2 and 3. In the present embodiment, the cover 40 is formed by an elastic recoverable material, and is substantially a semi-spherical shell. The second edge $E_2$ of the opening of the cover 40 includes three second recessions 410 (only one second recession 410 is illustrated in the diagram) indented from the second edge $E_2$. Each second recession 410 is complementary in size and shape to a corresponding first protrusion 323, so that the first protrusions 323 are received in corresponding second recessions 410 respectively.

Figure 5:
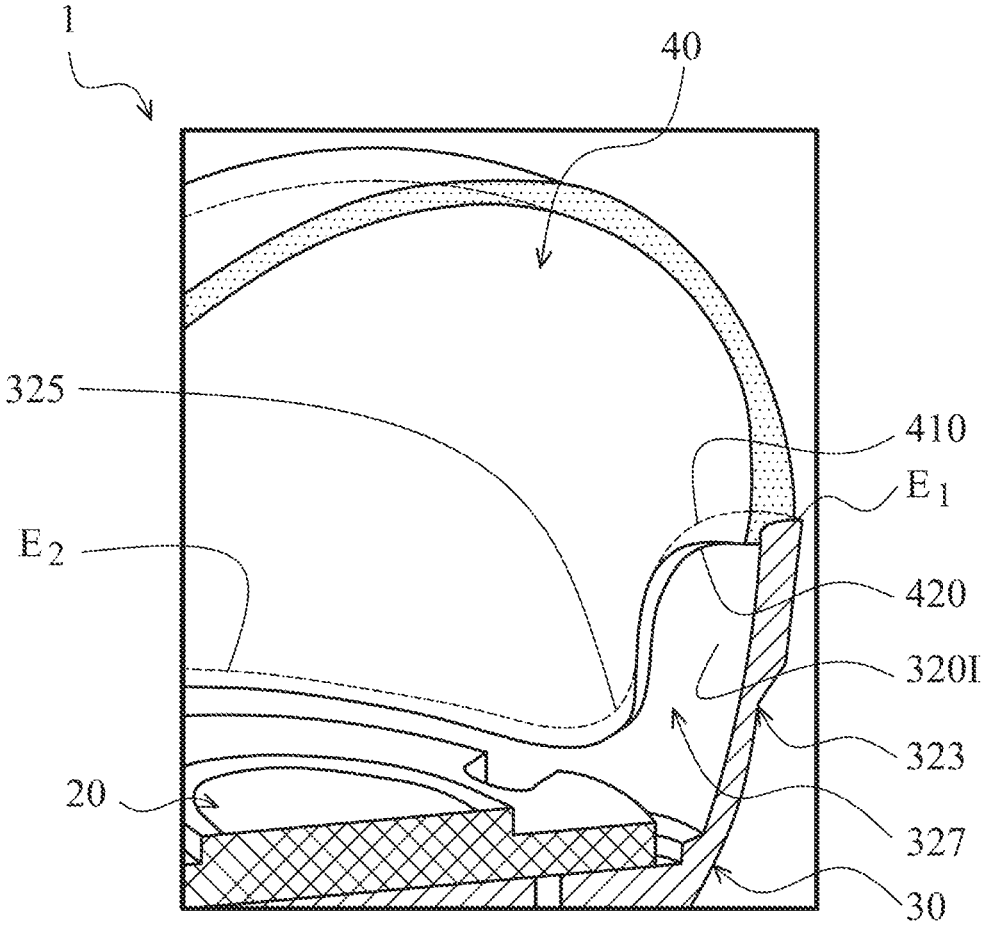
FIG. 5 shows a cross-sectional view of partial elements of an illumination structure according to an exemplary embodiment of the invention.

Referring to FIG. 5, a cross-sectional view of partial elements of an illumination structure 1 according to an exemplary embodiment of the invention is shown. The inner side of the opening of the cover 40, that is, the side closer to the illumination module 10, has a flange 420 continuously surrounding the inner surface 320I of the cylindrical shell 320 of the light base 30. In other words, both the inner side of the second edge $E_2$ of the cover 40 and the inner side of each second recession 41 include a flange 420. The flange 420 leans on the inner surface 320I of the light base 30 closer to the first edge $E_1$ and the inner surface of 320I of the first protrusions 323.

Figure 6:
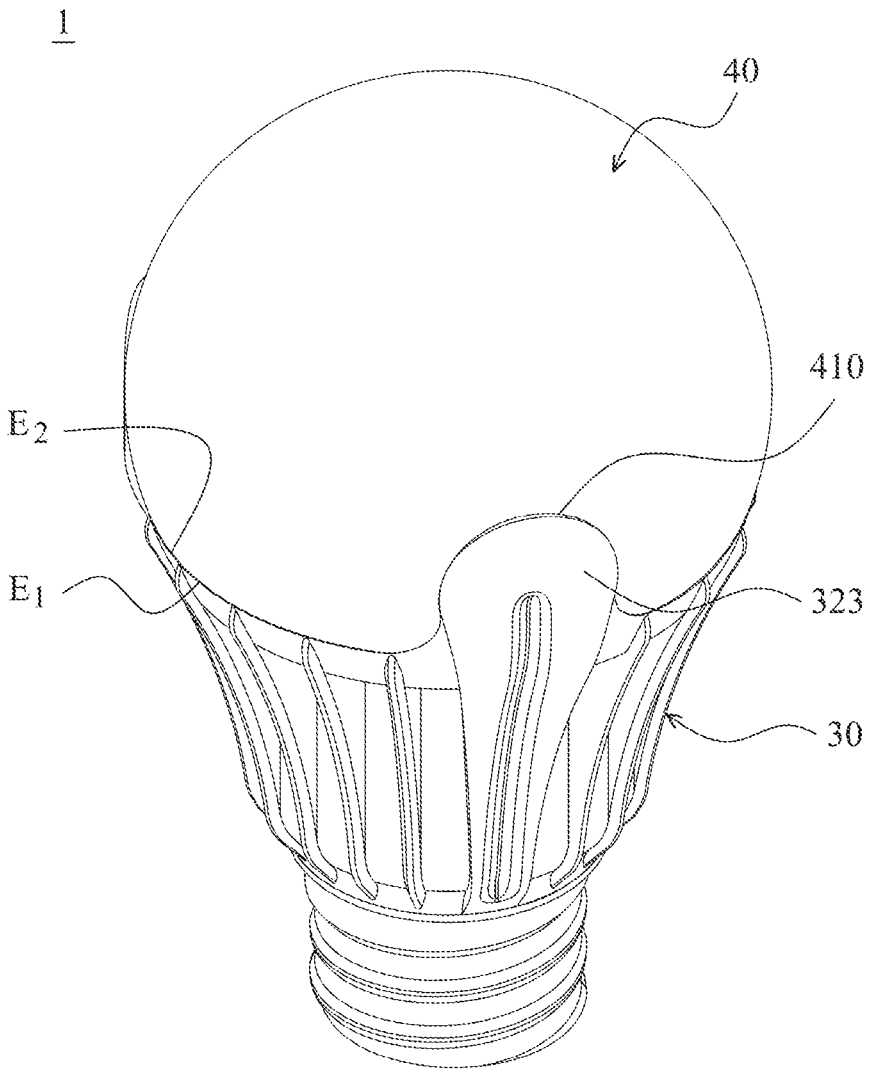
FIG. 6 shows a schematic diagram of an illumination structure after assembly according to an exemplary embodiment of the invention.

The assembly of the light base 30 and the cover 40 is as follows: Firstly, the cover 40 is pressed inwardly. Next, the second recessions 410 are aligned to the first protrusions 323, and the first protrusions 323 are received in corresponding second recessions 410. Lastly, the cover 40 is released and expands with its own recovery force. Given that the part of each first protrusion 323 closer to the first edge $E_1$ has two concave edge portions 325 and that the second recessions 410 are complementary in shape to the first protrusions 323, the first protrusions 323 and the second recessions 410 are firmly engaged with each other. Also, the inner side of the opening of the cover 40 is continuously surrounded by a flange 420, which tightly leans on the inner surface 320I of the light base 30 when the cover 40 expands with its own recovery force. As indicated in FIG. 6, the seal tightness between cover 40 and the light base 30 is effectively increased without applying any adhesive between the cover 40 and the light base 30.

On the other hand, the cover 40 can be detached from the light base 30 without causing any damage to the illumination structure 1. The user may detach the cover 40 from the light base 30 by pressing the cover 40 to detach the second recessions 410 of the cover 40 from the first protrusions 323. Additionally, since the first protrusions 323 of the light base 30 is protruded from the first edge $E_1$, the light may be reflected by the first protrusions 323 alone or the reflective material 327 disposed on the inner surface 320I of the first protrusions 323. Consequently, the light-emitting angle of the illumination structure 1 is increased.

Figure 7:
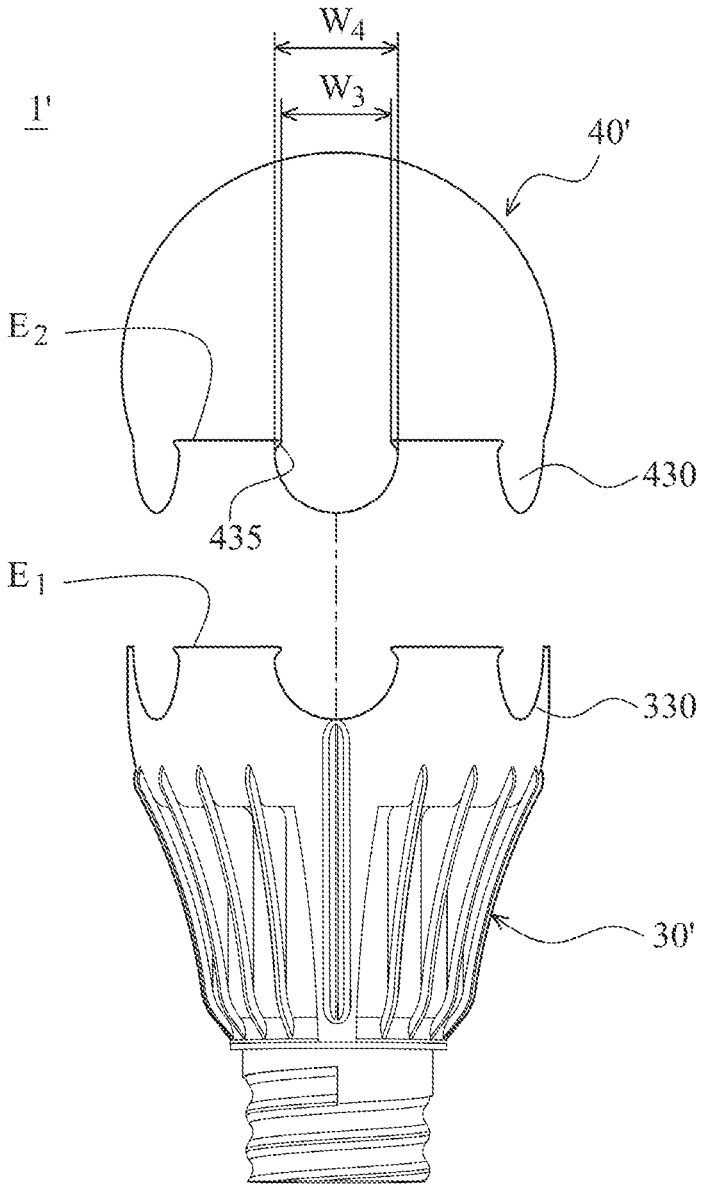
FIG. 7 shows a schematic diagram of an illumination structure according to another embodiment of the invention.

Referring to FIG. 7, a schematic diagram of an illumination structure 1' according to another embodiment of the invention is shown. The components of the illumination structure 1' identical or similar to that of the illumination structure 1 of FIGS. 2~6 retain the same reference numerals, and the similarities are not repeated. The illumination structure 1' is different from the illumination structure 1 in that the first edge $E_1$ of the light base 30' includes three first recessions 330, and the second edge $E_2$ of the cover 40'includes three second protrusions 430, wherein each first recession 330 is indented from the first edge $E_1$, and the second protrusions 430 extends upwards from the second edge $E_2$ in a direction towards the light base 30'. The first recessions 330 are complementary in size and shape to the second protrusions 430, so that the second protrusions 430 are received in corresponding first recessions 330 respectively.

In a practical embodiment, the shape of the second protrusions 430 is circular, the part of the second protrusions 430 closer to the second edge $E_2$ has a third width $W_3$, and the part of the second protrusions 430 farther away from the second edge $E_2$ has a fourth width $W_4$ greater than the third width $W_3$. Therefore, the part of each second protrusion 430 closer to the second edge $E_2$ has two concave edge portions 435 for the light base 30' to be conveniently engaged thereon.

In the above embodiment, the shape of the second protrusions 430 is circular, but the invention is not limited thereto. As indicated in FIG. 4, the second protrusions may be in the shape of a polygon such as pentagon, hexagon, oval, heart, rhombus, trapezoid, key head, or cross. Of the possible shapes of the second protrusions 430, the part of the second protrusions 430 with largest width is located between a side by which the second protrusions 430 is connected to the second edge $E_2$ and the outer end of the second protrusions 430 (including the outer end) for the light base 30' to be conveniently engaged thereon. Preferably, the part of the second protrusions 430 with largest width is located between the physical enter of the second protrusions 430 and its outer end.

Figure 8:
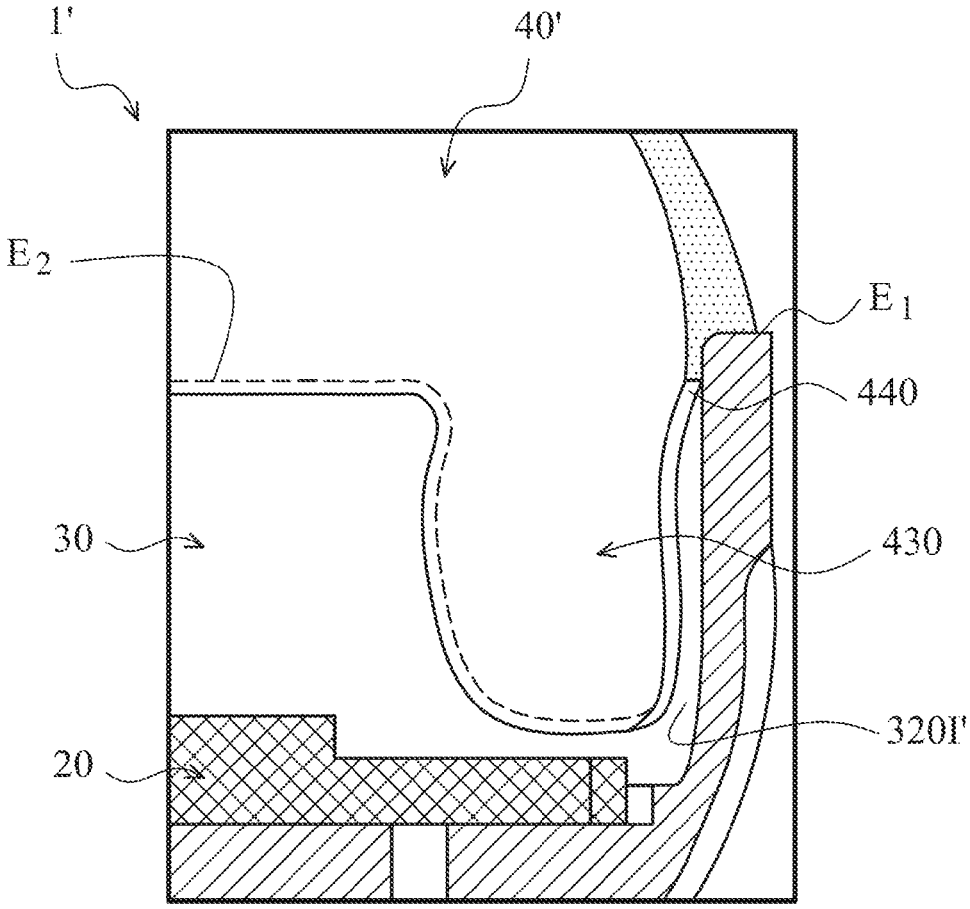
FIG. 8 shows a cross-sectional view of partial elements of an illumination structure according to another embodiment of the invention.

Referring to FIG. 8, a cross-sectional view of partial elements of an illumination structure 1' according to another embodiment of the invention is shown. The inner side of the opening of the cover 40', that is, the side closer to the illumination module 10, has a flange 440 continuously surrounding the inner surface 320l' of the light base 30'. In other words, both the inner side of the second edge $E_2$ of the cover 40' and the inner side of each second protrusions 430 include a flange 440 leaning on the inner surface 320l' of the light base 30'.

As indicated in FIG. 7 and FIG. 2, the light base 30 of the illumination structure 1 only includes a plurality of first protrusions 323 protruded from the first edge $E_1$, and the light base 30' of the illumination structure 1' only includes a plurality of first recessions 330 indented from the first edge $E_1$. However, anyone who is skilled in the technology of the invention will be able to make necessary modification based on the above two embodiments. For example, in an embodiment without accompanying drawing, the light base of the illumination structure may include both a plurality of protrusions protruded from the first edge and a plurality of recessions indented from the first edge, and the cover may include both a plurality of protrusions protruded from the second edge and a plurality of recessions indented from the second edge for respectively corresponding to the recessions and the protrusions of the light base.

Through the structural design of the cover and the light base of the illumination structure of the invention, the seal tightness between the cover and the light base is enhanced and the procedures required for assembling or disassembling the cover and the light base are simplified for the convenience of repairing and servicing the illumination structure.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An illumination structure, comprising:

an illumination module;

a light base, comprising a cylindrical shell and an electrical connector, wherein the cylindrical shell is used for receiving and supporting the illumination module, the cylindrical shell comprises a first end and a second end, the first end has a first edge comprising a plurality of first protrusions and/or first recessions, and the second end is connected to the electrical connector, the first protrusions are protruded from the first edge in a direction extended from the second end to the first end, and the first recessions are indented from the first edge in a direction extended from the first end to the second end; and a cover having a second edge, wherein the second edge comprises a plurality of second recessions and/or second protrusions, each second recession and/or each second protrusion is complementary in shape to a corresponding first protrusion and/or first recession, so that the first protrusions are received in corresponding second recessions respectively, and/or the second protrusions are received in corresponding first recessions respectively.

2. The illumination structure according to claim 1, wherein the second recessions and/or and the second protrusions of the cover respectively comprise an inner flange.

3. The illumination structure according to claim 1, wherein a part of the first protrusions closer to the first edge has a first width, and a part of the first protrusions farther away from the first edge has a second width greater than the first width.

4. The illumination structure according to claim 1, wherein a part of the second protrusions closer to the second edge has a third width, and a part of the second protrusions farther away from the second edge has a fourth width is greater than the third width.

5. The illumination structure according to claim 1, wherein shapes of the first protrusions and the second protrusions are circular or polygonal.

6. The illumination structure according to claim 1, further comprising a reflective material disposed on an inner surface of the first protrusions.

7. The illumination structure according to claim 1, wherein the first protrusions is used to reflect the light emitted by the illumination module.

8. The illumination structure according to claim 1, wherein the cover is formed by an elastic recoverable material.

9. The illumination structure according to claim 1, wherein each first protrusion and/or each second protrusion has two symmetric concave edge portions.

10. The illumination structure according to claim 1, wherein the light Base has an accommodation space for receiving a driving circuit module.

11. An assembly method of cover and light base for assembling a light base having a plurality of first protrusions protruded from the edge of the light base in a direction extended to a cover and/or first recessions indented from the edge of the light base in a direction extended away from the cover with the cover having a plurality of second recessions and/or second protrusions, wherein each second recession and/or each second protrusion is complementary in shape to a corresponding first protrusion and/or first recession, the cover is pressed inwardly until the second recessions are aligned to the first protrusions and/or the second protrusions are aligned to the first recessions, so that the first protrusions are received in corresponding second recessions and/or the second protrusions are received in corresponding first recessions respectively when the cover is released.

* * * * *